US005966848A

United States Patent [19]

Monteiro, Jr. et al.

[11] Patent Number: 5,966,848

[45] Date of Patent: Oct. 19, 1999

[54] TOOTH OF ORE RECOVERY BUCKETS

[75] Inventors: Carlos Alberto De Sampaio Monteiro, Jr.; Severino Almeida Neto; Manoel Damas Torres, all of SãoLouis–Maranhão, Brazil

[73] Assignee: Companhia Vale Do Rio Doce, Minas Gerais, Brazil

[21] Appl. No.: 08/980,751

[22] Filed: Dec. 1, 1997

[30] Foreign Application Priority Data

May 30, 1997 [BR] Brazil ..... MU 7701861

[51] Int. Cl.[6] ..... E02F 9/28

[52] U.S. Cl. ..... 37/452; 37/455; 299/100; 299/102

[58] Field of Search ..... 37/452, 454, 455; 299/100, 102, 112

[56] References Cited

U.S. PATENT DOCUMENTS

Re. 12,608 2/1907 Thomas .
916,271 3/1909 Conibear .
2,247,202 6/1941 Ratkowski .
3,286,379 11/1966 Benetti .

*Primary Examiner*—H. Shackelford
*Attorney, Agent, or Firm*—Helfgott & Karas, P.C.

[57] ABSTRACT

The present invention relates to an improvement in tooth of ore recovery buckets which comprises a single monobloc body 10 having an extreme posterior portion 1 with its upper face provided with an oblong undercut 2 provided with a pair of throughout round orthogonal holes 3 constituting the single body 10 definer of the tooth. Intermediately the single body 10 has a structural thickening 4 that extends itself downwards according to a prismatic shape providing a wedge 5 with a fluted anterior-inferior end 6. The entire surface of the upper inclined wall 7 and the lower horizontal wall 8 of this wedge 5 incorporates fluted transversal undercuts 9 parallel and spaced between themselves.

1 Claim, 2 Drawing Sheets

TOOTH OF ORE RECOVERY BUCKETS

FIELD OF INVENTION

The present invention relates to an improvement in tooth of ore recovery buckets. Specifically, the present invention relates to a solid tooth for the ore recovery buckets.

BACKGROUND OF INVENTION

As it is known by the technical experts in this field, conventional ore recovery bucket systems employ for the teeth assembly a set of parts comprising a wedge, a support, a claw and a chuck, which are arranged prior to place the tooth on the ore recovery bucket.

In spite of its large employment in the industries, these bucket teeth have multiple parts and presents a series of inconveniences such as:

a) the need to keep a stock of large number of parts proportional to the number of components required to the bucket tooth assembly;

b) the enormous difficulty to assemble each bucket tooth prior to its arrangement on the ore recovery bucket;

c) the significant lapse of time demanded for the assembly of one bucket tooth before it is arranged on the ore recovery bucket;

d) the high cost of labor to complete the assembly of teeth to be arranged on the buckets;

e) the short useful life of the teeth since it comes with movable parts which are fitted together and are therefore subject to wear at its connection points.

As a whole, all of the foregoing aspects are unfavorable to the conventional ore recovery bucket systems and represent a great deal of financial losses to the maintenance shops and a great deal of time on labor for the substitution of the teeth on the ore recovery buckets.

SUMMARY OF INVENTION

The objective of the present invention is to provide a new arrangement to be introduced in the tooth of the ore recovery buckets which significantly reduces the number of parts kept in the stock room for bucket's assembly and maintenance workshops.

Another objective of the present invention is to provide a new arrangement to be introduced in the tooth of the ore recovery buckets which makes it easier to place a tooth in the ore recovery bucket.

Another objective of the present invention is to provide a new arrangement to be introduced in the tooth of the ore recovery buckets which enables the direct installation of the tooth in the ore recovery unit.

Another objective of the present invention is to provide a new arrangement to be introduced in the tooth of the ore recovery buckets which provides a low labor cost for the assembly and installation of the teeth on the bucket.

Another objective of the present invention is to provide a new arrangement to be introduced in the tooth of the ore recovery buckets which is a significant increase of the teeth useful life.

These and the other objectives and advantages of the present invention are achieved through the improved arrangement introduced in the tooth of ore recovery buckets which comprises of a single monobloc body having a posterior end portion of a transversal rectangular section of a parallelepiped shape with the upper face provided with an oblong undercut which is provided with a pair of throughout round orthogonal holes. The orthogonal holes are arranged concentrically with the respective rounded edges of the oblong undercut of the end portion constituting the support of the tooth. Intermediately, the single body presents a structural thickening which extends downward the equivalent of twice the thickness of the tooth support. From this intermediary portion which is structurally thicker the single body extends itself forward according to a prismatic form which provides a wedge shape with a beveled forward lower end. The entire inclined surface of the upper and horizontally flat wall of this wedge incorporates fluted transversal undercuts parallel and spaced between themselves thus complementing the monobloc part.

BRIEF DESCRIPTION OF DRAWINGS

The present invention will be now described in accordance with the attached drawings which are not to be considered as restrictive of the scope of the invention.

DETAILED DESCRIPTION OF DRAWINGS

Figure 1:
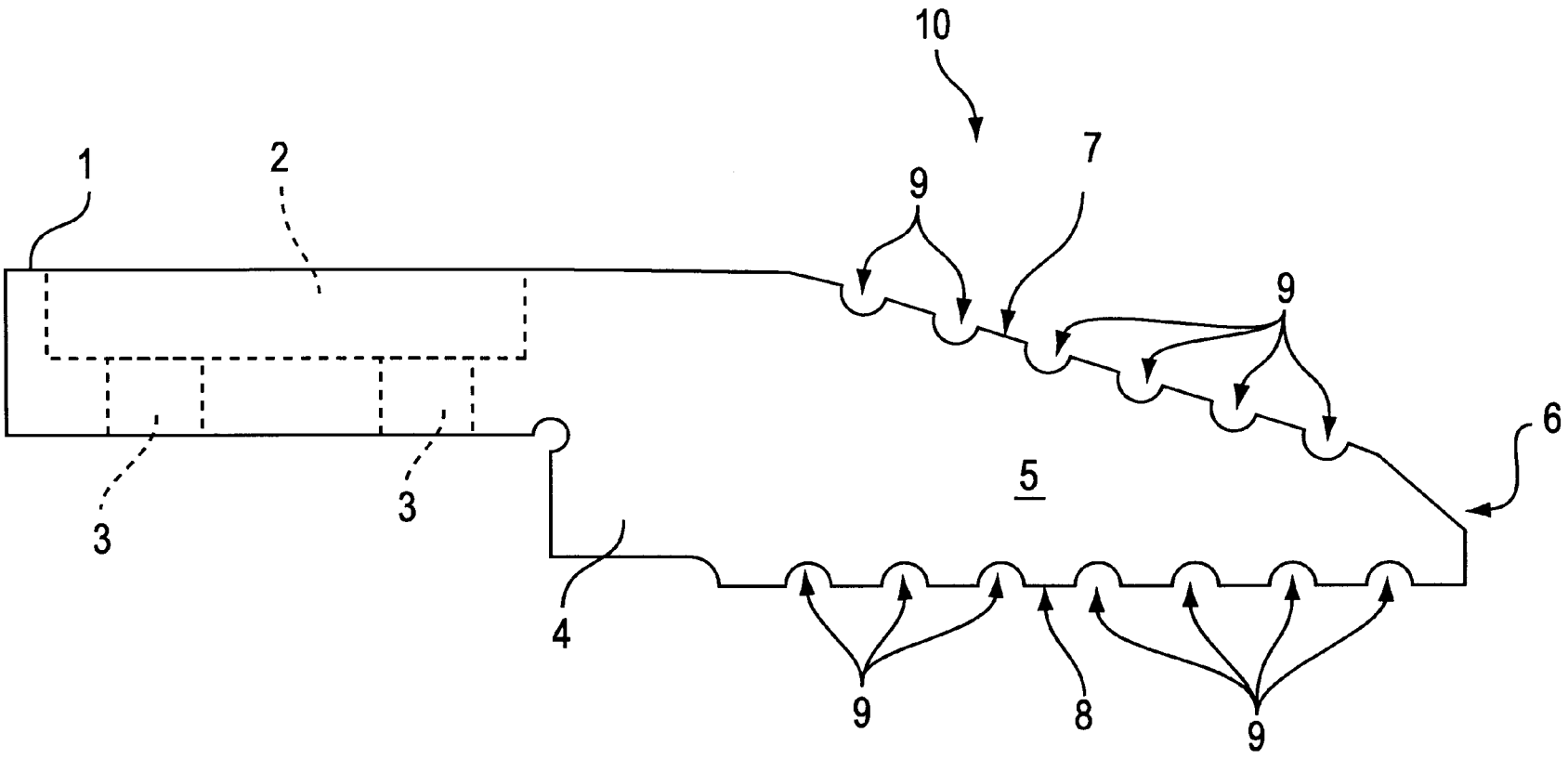
FIG. 1 is a side view of the improved bucket tooth.
Figure 2:
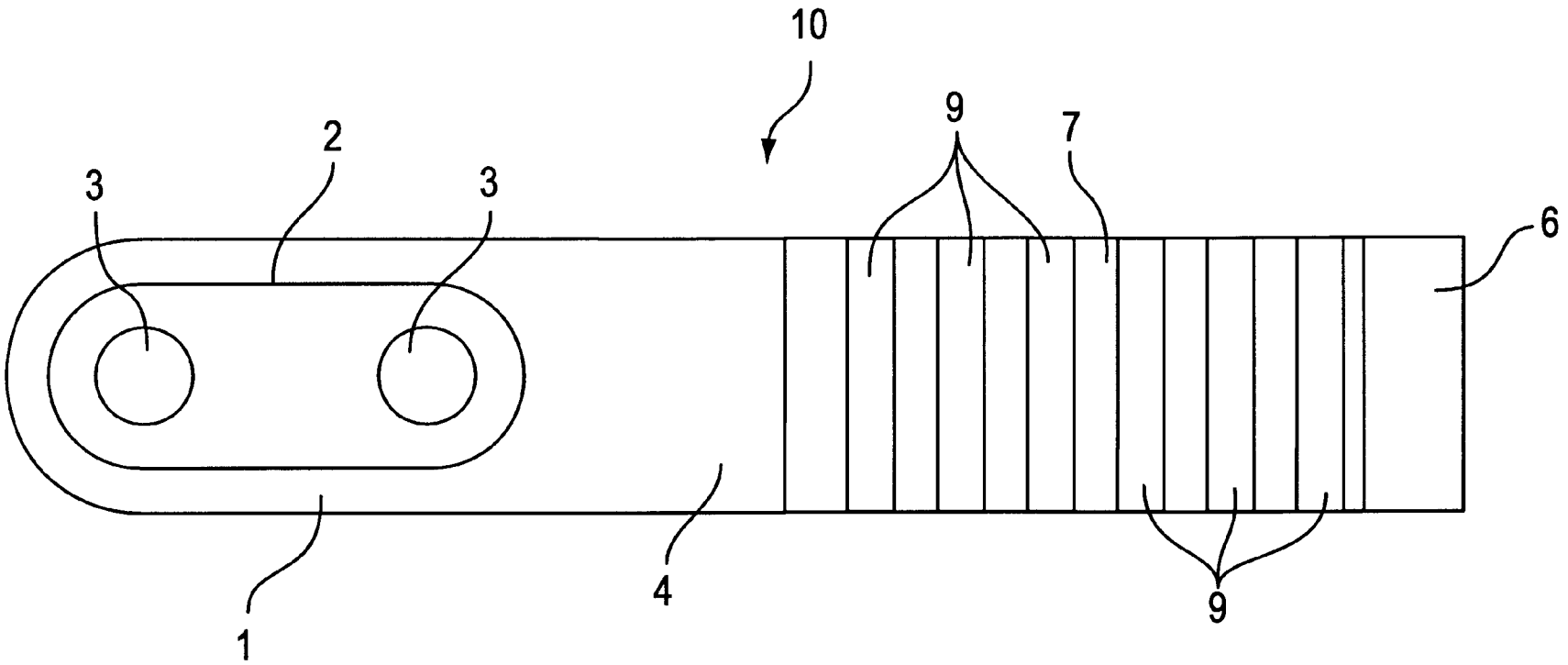
FIG. 2 is a top view of the bucket tooth as shown in FIG. 1.

According to FIGS. 1 and 2 the improved arrangement in the teeth for ore recovery buckets of the present invention comprising a single monobloc body 10 having an extreme posterior portion 1 shaped as a parallelepipedal form with a rectangular cross-section. The upper face of the monobloc body 10 is provided with an oblong undercut 2 which extends downwards the equivalent of half the thickness of said end portion 1.

Inside of the oblong undercut 2 is provided a pair of throughout orthogonal and round holes 3 concentrically arranged with the respective rounded edges of said oblong undercut 2 of this end portion 1. This arrangement constitutes the support of the single body which defines the bucket tooth 10.

Intermediately, the single body 10 presents a structural thickening 4 which extends downwards the equivalent of twice the thickness of the end portion 1 of the tooth 10, so that from this intermediary thicker structural portion 4 the single body 10 extends forward according to a prismatic shape 5 and providing a wedge format with its beveled anterior-inferior end 6. The entire surface of the upper inclined wall 7 and the lower horizontal wall 8 of the wedge 5 incorporates a plurality of fluted undercuts 9 that run transverse to a line extending from the anterior end to the posterior end and are parallel and spaced from each other.

Despite having been described and illustrated a preferable embodiment concept for the monobloc tooth 10, it behooves to point out that it is possible to make any structural changes without any deviations from the scope of the present invention.

We claim:

1. An improvement in a tooth of an ore recovery bucket, which comprises a single monobloc body with a posterior end portion provided with an oblong undercut on its upper face, said oblong undercut being provided with a pair of round orthogonal throughholes arranged concentrically with respective rounded edges of said oblong undercut constituting support for said single monoblock body of said bucket; intermediately said single monobloc body having a structural thickening which extends in a direction opposite the direction of the upper face and is the equivalent of twice the thickness of the tooth's support; the single monobloc body extends forward in a prismatic shape forming a wedge with a beveled upper surface at an anterior end; said wedge having an upper inclined wall and a lower horizontal wall the entire surface of the upper inclined wall and the lower horizontal wall of said wedge incorporates a plurality of fluted undercuts that run transverse to a line extending from the anterior end to the posterior end and are parallel and spaced from each other.

* * * * *